US005588845A

United States Patent [19]

Naitoh et al.

[11] Patent Number: 5,588,845

[45] Date of Patent: Dec. 31, 1996

[54] CONNECTORS FOR BASE BOARDS AND METHODS OF CONNECTOR OF BASE BOARDS

[75] Inventors: Takaki Naitoh, Inagi; Okitsugu Furuya, Tokyo, both of Japan

[73] Assignee: The Whitaker Corporation, Wilmington, Del.

[21] Appl. No.: 351,982

[22] Filed: Dec. 8, 1994

[30] Foreign Application Priority Data

Feb. 9, 1994 [JP] Japan ..... 6-036551

[51] Int. Cl.[6] ..... H01R 4/58; H01R 9/09

[52] U.S. Cl. ..... 439/66; 439/74

[58] Field of Search ..... 439/91, 66, 67, 439/65, 74

[56] References Cited

U.S. PATENT DOCUMENTS

| | | | |
|---|---|---|---|
| 3,985,413 | 10/1976 | Evans | 439/66 |
| 4,636,018 | 1/1987 | Stillie | 439/66 |
| 5,052,936 | 10/1991 | Biechler et al. | 439/60 |
| 5,160,268 | 11/1992 | Hakamian | 439/66 |
| 5,161,981 | 11/1992 | Deak et al. | 439/66 |
| 5,259,770 | 11/1993 | Bates et al. | 439/66 |

FOREIGN PATENT DOCUMENTS

| | | |
|---|---|---|
| 0459400A1 | 5/1991 | European Pat. Off. . |
| 2058427 | 4/1981 | United Kingdom . |

OTHER PUBLICATIONS

W. Bates et al, "A Unique, Solderless, Surface Mount Interconnection System", 1992, pp. 1–18.

*Primary Examiner*—Neil Abrams
*Assistant Examiner*—Eugene G. Byrd

[57] ABSTRACT

This invention offers a connector for base boards and a method for connecting base boards which is of low profile and produces highly reliable electrical connections due to the fact that it does not generate pressure applied perpendicularly to the base boards which may result in their warping. Connectors for base boards 10, 10' consist of the primary and secondary connectors **20*a*, 20*b* having L-shaped contacts 50 which are attached, preferably using the SMT method, to the lands 61, 62 formed on the matching surfaces of the base boards 60*a*, 60*b*. A longitudinal groove 41 is made in the primary connector housing 40*a*, and contacting sections 52, 52 of the contacts 50*a* of the primary connector 20*a* and contacts 50*b* of the secondary connector 20*b*, which is inserted in the groove 41, are connected by means of an elastic connecting component 30**.

18 Claims, 7 Drawing Sheets

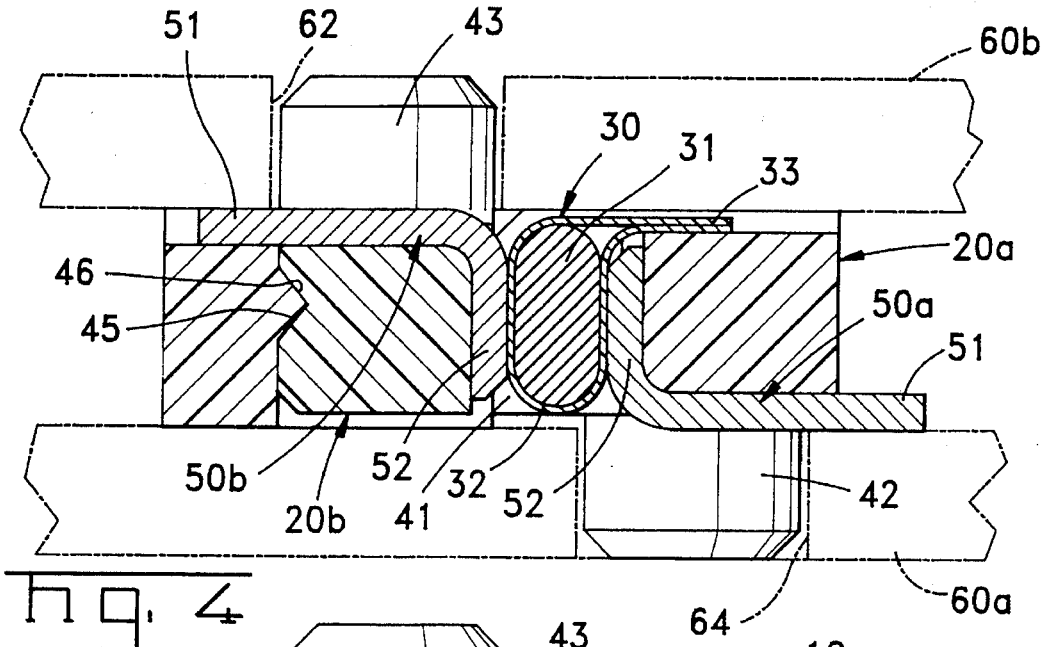
Fig. 4
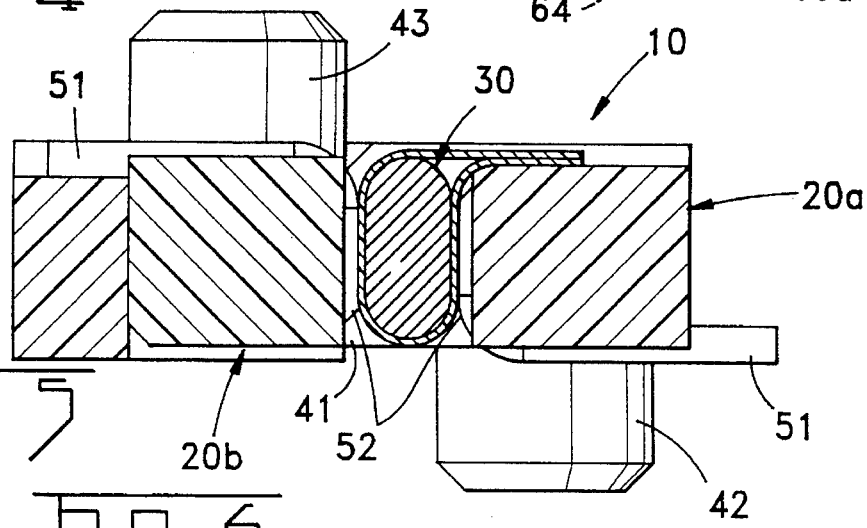
Fig. 5
Fig. 6
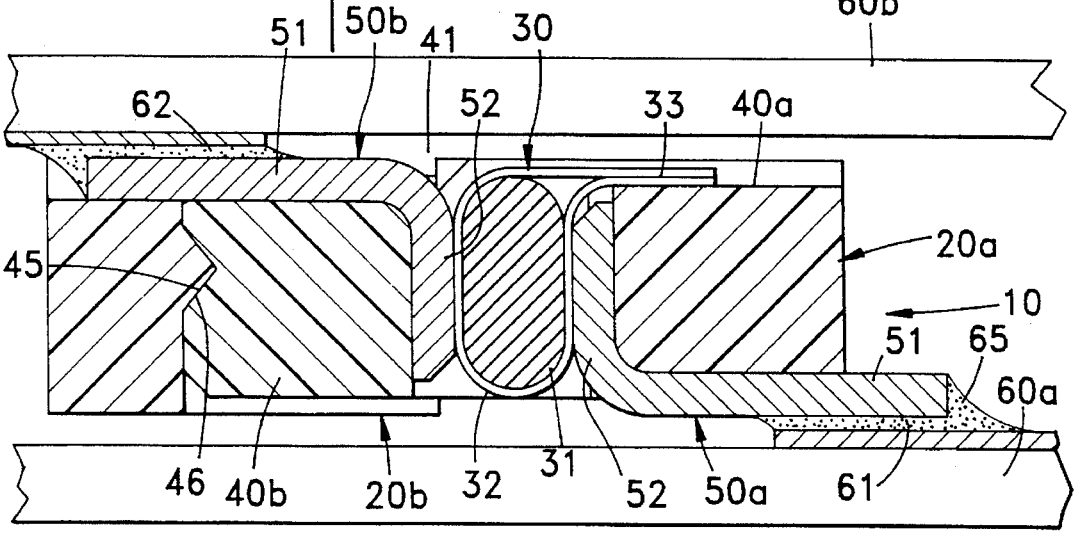

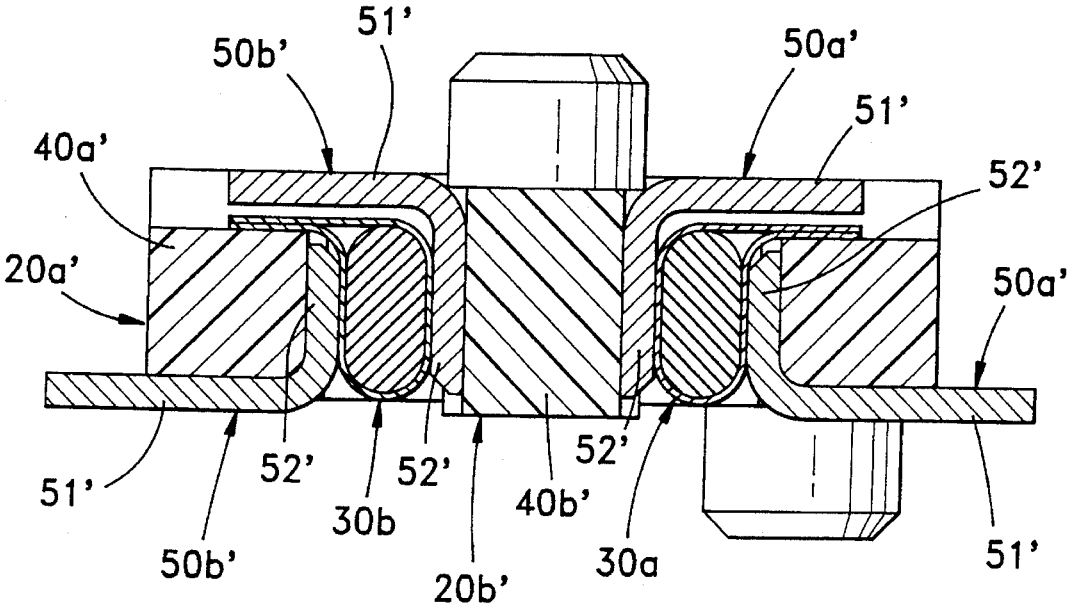
Fig. 9
(PRIOR ART)
Fig. 10
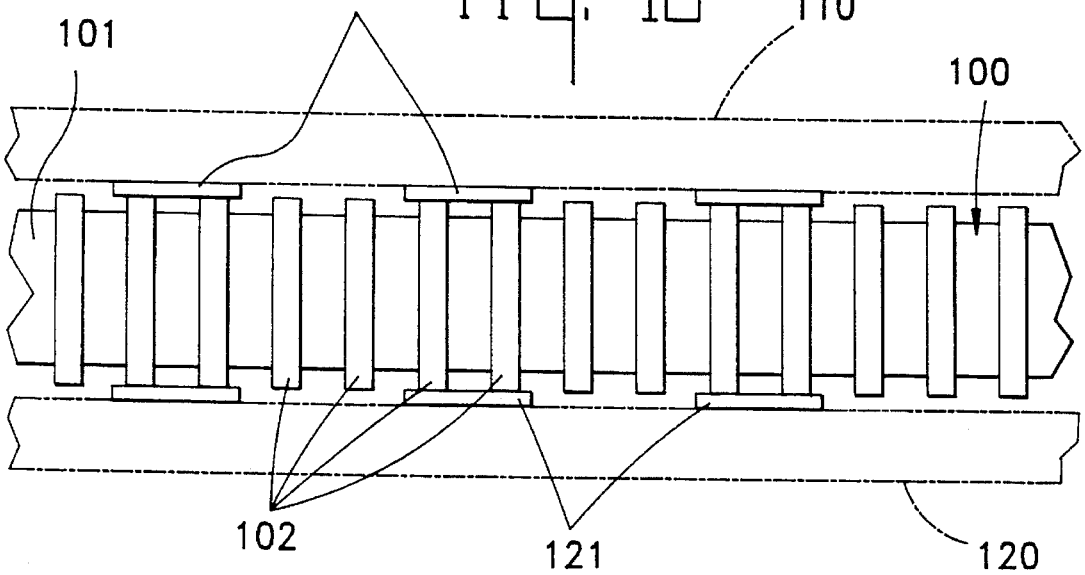

CONNECTORS FOR BASE BOARDS AND METHODS OF CONNECTOR OF BASE BOARDS

FIELD OF THE INVENTION

This invention relates to electric connectors, especially to connectors for producing connections between multiple lands (pads) formed on base boards (or circuit boards) and to methods of connecting base boards.

BACKGROUND OF THE INVENTION

Description of the Prior Art

The density of components in electronic devices has recently rapidly increased in response to requirements toward their miniaturization. In order to increase the density of electronic circuitry, a number of designs for connectors used for connecting circuit boards have been proposed and implemented.

An example of connectors for base boards having low profile intended for connection (parallel to each other) of a pair of base boards having multiple lands arrayed on the internal (facing each other) surfaces is shown in FIG. 5. It is an elastomer connector (an elastic connecting component) manufactured by AMP Incorporated (Harrisburg, Penn., U.S.A.) and distributed under the AMPLIFLEX trademark. Another example of elastomer connectors is described in U.S. Pat. No. 4,636,018.

As can be seen from FIG. 10, a conventional elastomer connector 100 consists of a rod-shaped core 101 made of an elastomer material (insulating elastic material), such as, for example, silicone rubber, to the external surface of which ring-shaped conducting layers 102 are applied at regular intervals in a highly dense array. This elastomer connector 100 is pressed between the inner surfaces of the first and second 110, 120 base boards having multiple electrical lands or traces 111, 121 in the form of straight lines. When the lands 111, 121 are aligned and both base boards 110, 120 are pressed together, elastomer core 101 of elastomer connector 100 is deformed, thus producing connection between lands 111, 121 by means of conducting layers 102.

However, it is difficult to achieve reliable connections using such a conventional connector for base boards or an elastomer connector 100 due to the fact that the elastomer connector 100 is deformed by applying a great pressure to the base boards 110, 120 resulting in pressing the conducting layer 102 located at the circumference of the elastomer connector to the lands 111, 121 to make electric connection between them without producing wiping action. This problem becomes more serious if either of the base boards 110 or 121 is warped under the pressure making it impossible to create correct and reliable connections between all the lands.

In order to prevent the warping of the base boards 110, 120, it is necessary to maintain the distance between the base boards unchanged by securing them by several screws along the lands 111, 121. However, screws take some space, thus decreasing space available for the lands. Another disadvantage of such a solution is a substantial reduction in productivity of the assembly operations.

Another method of preventing the warping of the base boards consists in reinforcing the boards by making them thicker or in providing them with a reinforcing plate in the area of connection sections. However, if thicker boards or additional reinforcing plates are used, the overall thickness of the device will also increase, thus decreasing the density of mounting.

SUMMARY OF THE INVENTION

Therefore, the purpose of this invention is to offer a new low-profile connector for base boards and a new method of connecting them which makes it unnecessary to apply great pressure to the base boards and eliminates the danger of warping which is suitable for high-density applications and makes it possible to produce reliable connections.

In order to eliminate the above-mentioned disadvantages of conventional devices and to achieve the purposes stated above, connectors for base boards according to this invention are equipped with contacts for connecting the lands of the first and second base boards having connecting sections and contacting sections. It is preferable that the contacting sections of these contacts are made perpendicular to the base board, and the elastic component of an elastomer connector is inserted between them, thus forming the connection.

The method of connection of base boards according to this invention consists in the connection of the primary contacts to the lands of a first base board using preferably surface-mounting technology and by inserting the elastic connecting component between the contacting portions of primary contacts and secondary contacts fixed to a second base board similarly to the primary contacts.

In the connectors for base boards of such a design, the danger of warping is eliminated because the pressure is directed parallel to the surface of the base boards. In addition, since the connection is carried out by means of contacts, a wiping action is produced between the contacting portions of the contacts and the elastic contacting component resulting in reliable an electric connection even if dust, oxides or other foreign objects are present on the surface of the contacts.

BRIEF DESCRIPTION OF THE DRAWINGS

Embodiments of the invention will now be described by way of example with reference to the accompanying drawings in which:

FIG. 3 is a front elevational view of the connector of FIG. 1.

FIGS. 4 and 5 are cross-sectional views taken along line 4—4 and 5—5 of FIG. 3.

FIG. 6 is a view similar to FIG. 4 showing the connector connected to base or circuit boards.

FIGS. 7–9 are views similar to FIGS. 1–3 showing an alternative embodiment of the connector.

FIG. 10 is a part front elevational view showing a prior art connector.

DETAILED DESCRIPTION OF THE PREFERRED EMBODIMENTS

Below, detailed explanations concerning the embodiments of connectors for base or circuit boards and methods for the connection thereof according to this invention with reference to attached drawings are provided.

Figure 1:
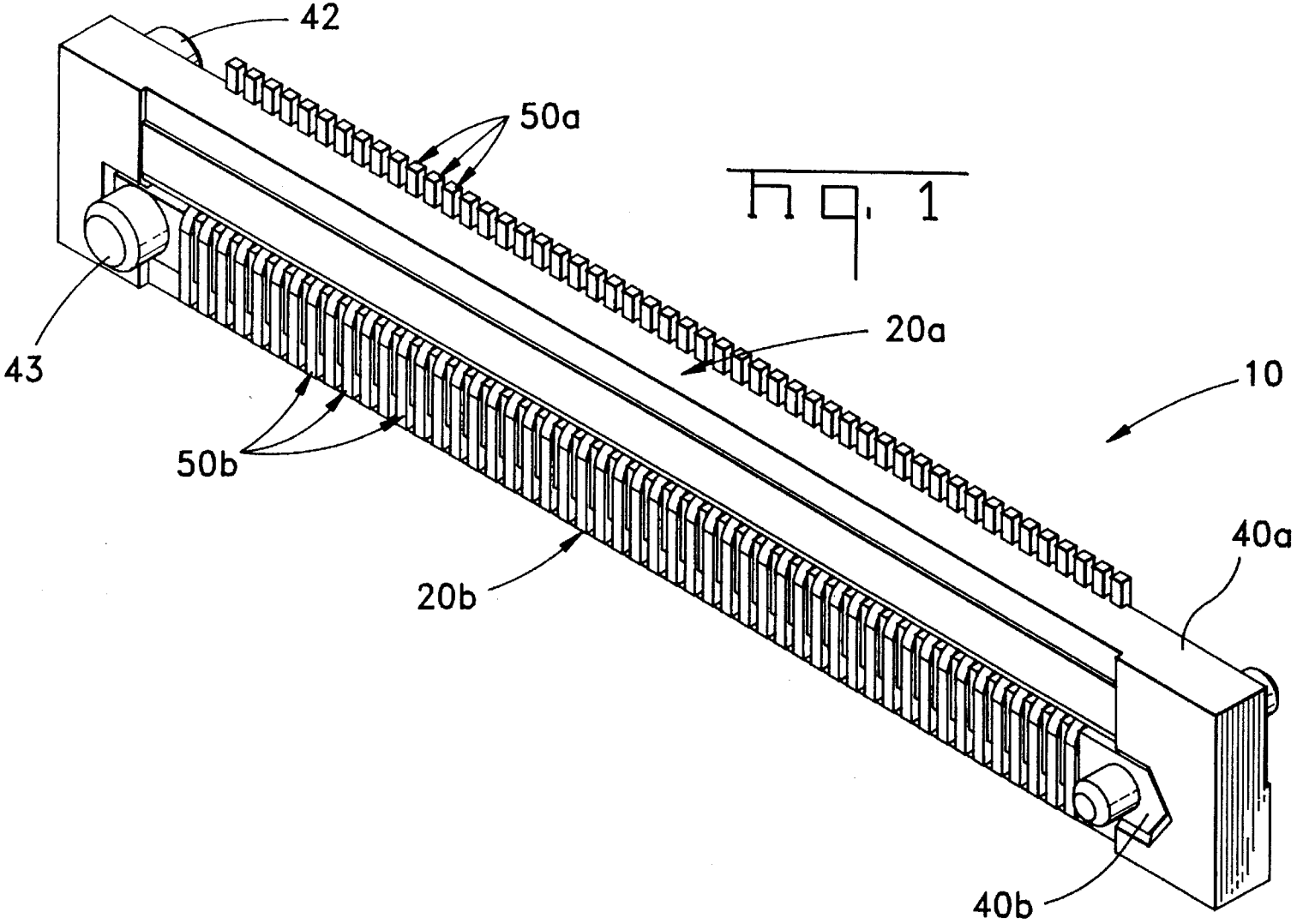
FIG. 1 is a perspective view of an assembled connector of this invention.
Figure 2:
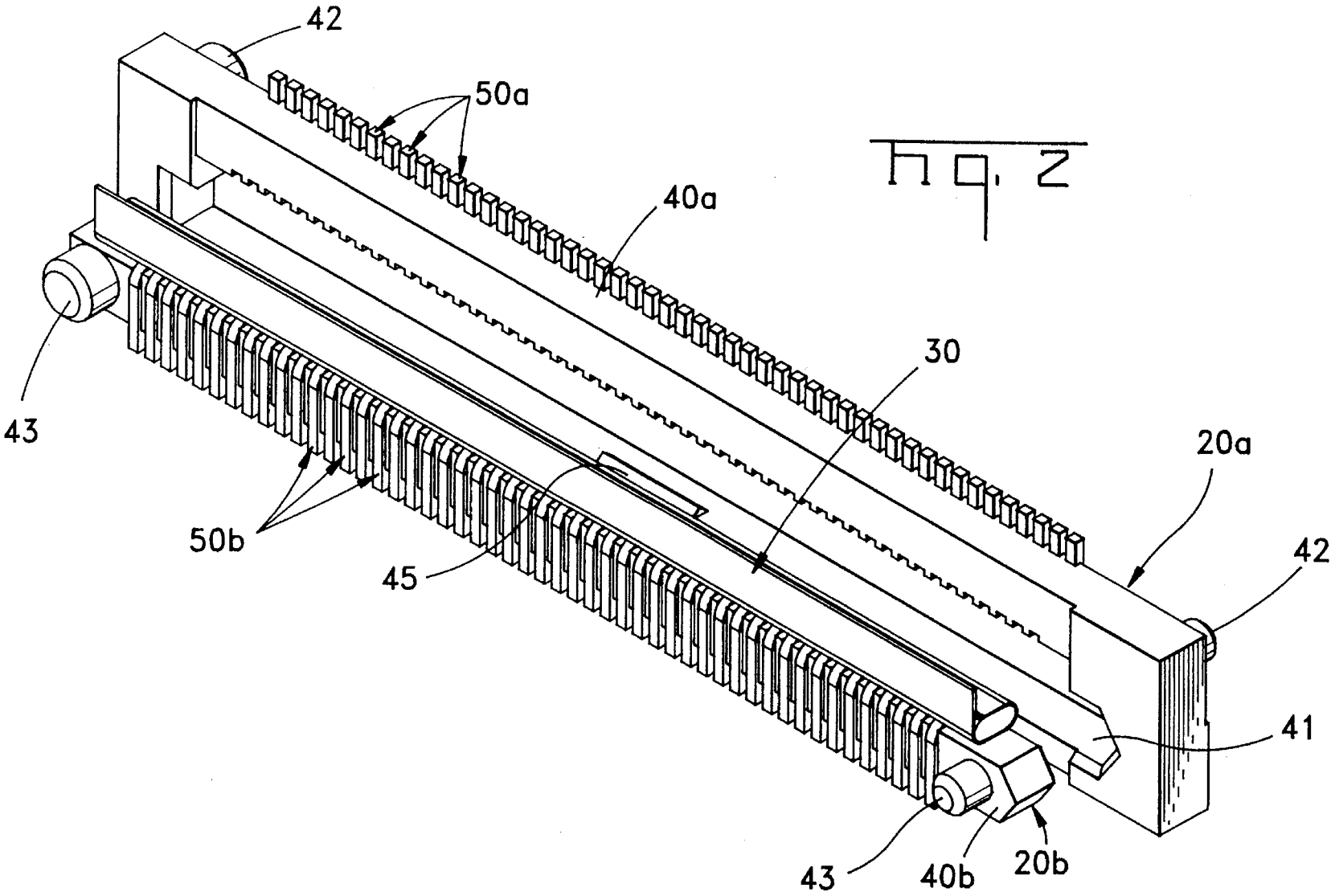
FIG. 2 is an exploded perspective view of the connector of FIG. 1.

FIG. 1 represents the preferred embodiment of a connector and a connection method for base boards according to this invention; FIG. 1 is a perspective view of the assembled connector; FIG. 2 is an exploded perspective view, and FIG. 3 is a front view of the connector, that is as it is seen from the left in FIG. 1.

This connector 10 for base boards consists of the first connector 20*a*, second connector 20*b* and an elastic connecting component (elastomer connector) 30. The primary and secondary connectors 20*a*, 20*b* have rectangular elongated housing 40*a*, 40*b* in which multiple contacts 50*a*, 50*b* are arranged in a high-density array. In the longitudinal direction of the housing 40*a* of the primary connector 20*a*, a groove 41 is made, preferably of a non-symmetrical configuration. As can be seen from the FIG. 1, the secondary connector 40*b* and the elastic connecting component 30 are inserted in this groove 41. Near the both ends of one surface of the housing 40*a*, two alignment posts 42 are formed. The housing 40*b* of the secondary connector 20*b* has such dimensions that it fits in the groove 41 of the housing 40*a* of the primary connector 20*a*, and it has alignment posts 43 near the both ends of its surface.

As it will be explained in more detail below, then the housings 40*a*, 40*b* of the primary and secondary connectors 20*a*, 20*b* multiple contacts 50*a*, 50*b* are placed in a high-density arrangement. Contacts 50*a*, 50*b* are of an L shape and they have connecting sections 51 intended for the connection to the lands and contacting sections 52 intended for making connection with matching contacts. Contacts 50*a*, 50*b* have connecting sections 51 for SMT mounting (surface mount soldering) which slightly extend from the surfaces of the housings 40*a*, 40*b* on which the alignment posts 42, 43 are formed, and contacting sections 52 extending perpendicular to surface of the base board inside of the groove 41 of the primary connector 20*a*

The specific embodiment shown in the FIG. 1 has a 32 mm long, 5 mm wide and 1.5 mm high (excluding alignment posts 42, 43) housing 40*a* ; it has fifty contacts 50 arranged at a pitch of 0.5 mm. It is a matter of fact that, depending on specific needs, other dimensions may be chosen as well.

FIGS. 4 and 5 represent cross sections along lines 4—4 and 5—5 in FIG. 3. In FIG. 4, an opposed configuration of contacts 50*a* and 50*b* is shown; FIG. 5 represents a portion of the connector where no contacts 50*a*, 50*b* are present. In FIG. 4 the first and the second base boards 60*a* and 60*b* are shown by phantom lines; the hatched areas relate only to a part of cross-sectioned details and other details are omitted.

As can be clearly seen from FIGS. 1–5, the connector 10 for base boards according to this invention has primary and secondary connectors 20*a* and 20*b*. In the assembled and connected condition, that is in the position depicted in FIG. 1, and as can be seen from FIG. 4, the secondary housing 40*b* of the connector 20*b* is inserted in the opening 41 of the primary housing 40*a* of the connector 20*a*. The contacting sections 52 of the primary and secondary contacts 50*a*, 50*b* retained in the housings 40*a*, 40*b* are arranged parallel to each other and perpendicular to the surfaces of the first and the second base boards 60*a*, 60*b*. The elastic connecting component 30 is inserted between the contacting sections 52 of the primary and secondary contacts 50*a*, 50*b*.

The elastic connecting component 30 is practically of the same design as the conventional elastomer connector 100 shown in FIG. 10. It consists of an elastomer core 31 of an elliptical or oval cross section with multiple conducting paths arranged parallel to each other at its circumference at a high-density pitch. In this specific embodiment, the conducting paths are made on a flexible circuit substrate (FFC) 32 by a printing or etching technique wound around the elastomer core 31 rather than make them directly on the core. The ends of this flexible circuit substrate 32 are pulled to one side (in the drawing, at the top) and secured by a securing means 33 such as adhesive.

It is desirable to keep the housings 40*a*, 40*b* together when the primary and secondary connectors 20*a* and 20*b* are joined. For this purpose, as shown in the FIGS. 2 and 4, an auxiliary latching device 45, 46 is provided in the form of a key way made in the inside wall of the groove 41 of the primary connector housing 40*a* and a protrusion made on the outside wall of the secondary connector housing 40*b* in the center or along its entire length. When the primary and secondary connectors 20*a*, 20*b* are joined together, wiping action takes place between conducting paths (not shown in the drawing) of the elastic connecting component 30 and the contacting sections 52 of the primary and secondary contacts 50*a*, 50*b*, which can be best seen in the FIG. 4. The elastic connecting component provides pressure necessary for maintaining reliable connection between the contacting sections 52. It is desirable to plate contacting sections 52 and surfaces of the conducting path of the elastic connecting component 30 with gold or other corrosion resistant noble metal.

As follows from the above explanations, the elastic connecting component 30 is retained between primary and secondary contacts 20*a*, 20*b* parallel to the base boards. Therefore, there is no vertical pressure applied directly to the first and second base boards 60*a*, 60*b*, resulting in total absence of warping in the base boards 60*a*, 60*b*. For the purposes of proper alignment of connecting sections 51 of the contacts 50*a*, 50*b* with the corresponding lands 61, 62 of the base boards 60*a*, 60*b*, alignment posts 42, 43 are provided on the housings 40*a*, 40*b* of the primary and secondary connectors 20*a*, 20*b* which fit in the alignment holes 62, 64 of the base boards 60*a*, 60*b*. These alignment posts 42, 43 can be made as 1.5 mm diameter cylindrical columns with tapered tips. It is preferable to make the posts at different ends of the housings of different size to assure proper connection.

Next, an explanation is given concerning the method of connection according to this invention of base boards with reference to FIG. 6 which shows basically the same elements as in the FIG. 4, only enlarged. On the matching surfaces of the base boards 60*a*, 60*b*, a number of lands 61, 62 are formed. These lands 61, 62 are preliminarily coated with a cream solder 65 in the same manner as in conventional SMT methods. First, the primary connector 20*a* is placed on the inside surface of the first base board 60*a* in such a way that the connecting sections 51 of the primary contacts 50*a* are aligned with the lands 61. The primary contacts 50*a* are connected to the lands 61 using the same methods as in SMT methods, for example, by heating the connecting sections 51 by means of infra red radiation, thus melting cream solder 65. Similarly, again using SMT methods, the connecting sections of secondary contacts 50*b* of the secondary connector 20*b* are connected to the second base board 60*b*. The primary and secondary connectors 20*a* and 20*b* are connected to base boards 60*a*, 60*b* using the SMT method.

After that, the elastic connecting component 30 is inserted in the groove 41 of the primary connector housing 40*a*. FFC 32 is inserted into the right side of the groove 41 as shown in FIG. 6 so that its outer surface and the contacting section 52 of the primary contact 50*a* actually makes contact. The ends 33 of the FFC 32 can be secured to the primary housing 40*a* by an adhesive. Then, the first and second base boards.

60*a*,60*b* are aligned and pressed together so that secondary housing 40*b* is inserted in the groove 41 of the primary housing 40*a* and locked by means of the locking devices 45, 46. In this state, the contacting sections 52, 52 of both contacts 50*a*, 50*b* are connected together by means of the elastic connecting component 30.

In the above explanation, the case of only one connector 10 is used for connection of base boards 60*a*, 60*b*. But this method is also applicable to the case when the base boards 60*a*, 60*b*are connected by several connectors 10 for base boards.

Figure 7:
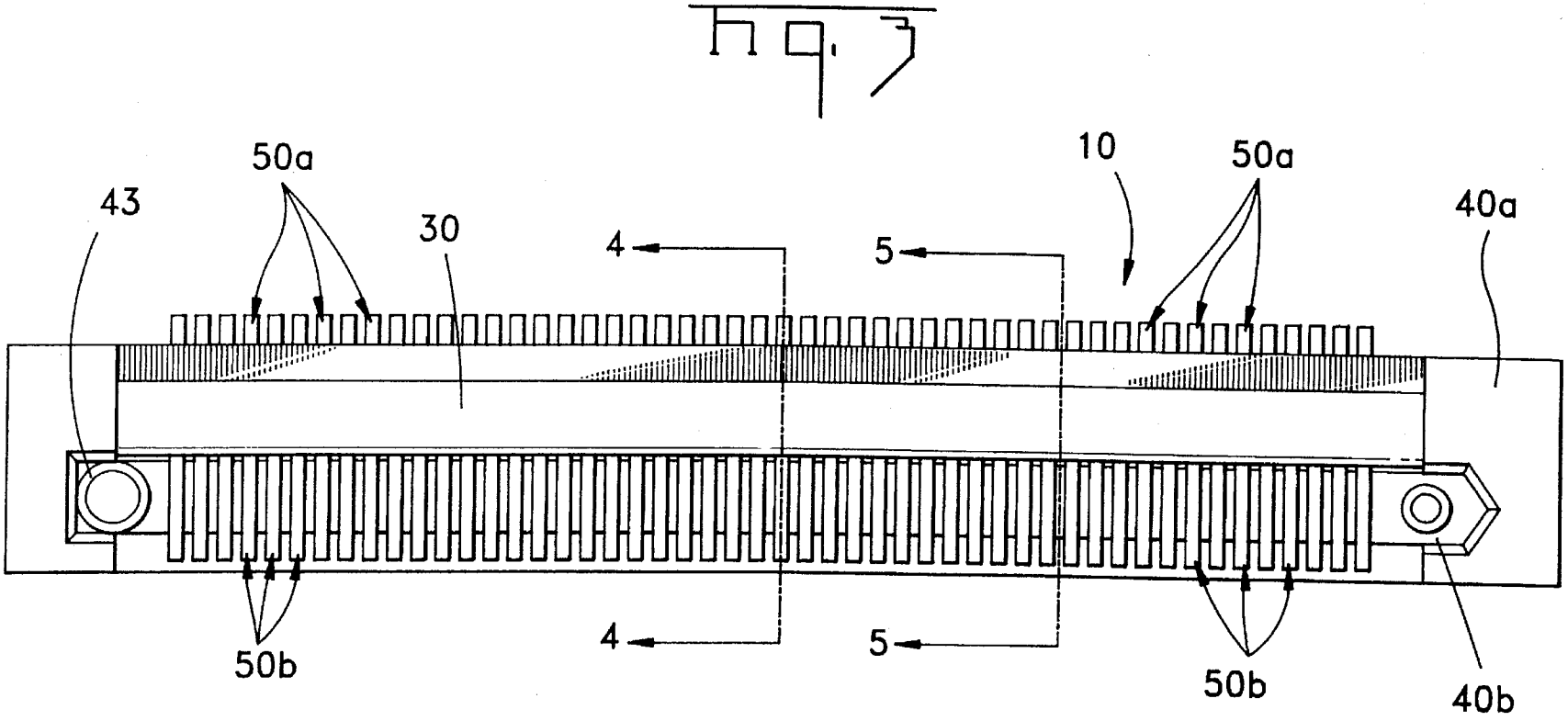
Figure 7:
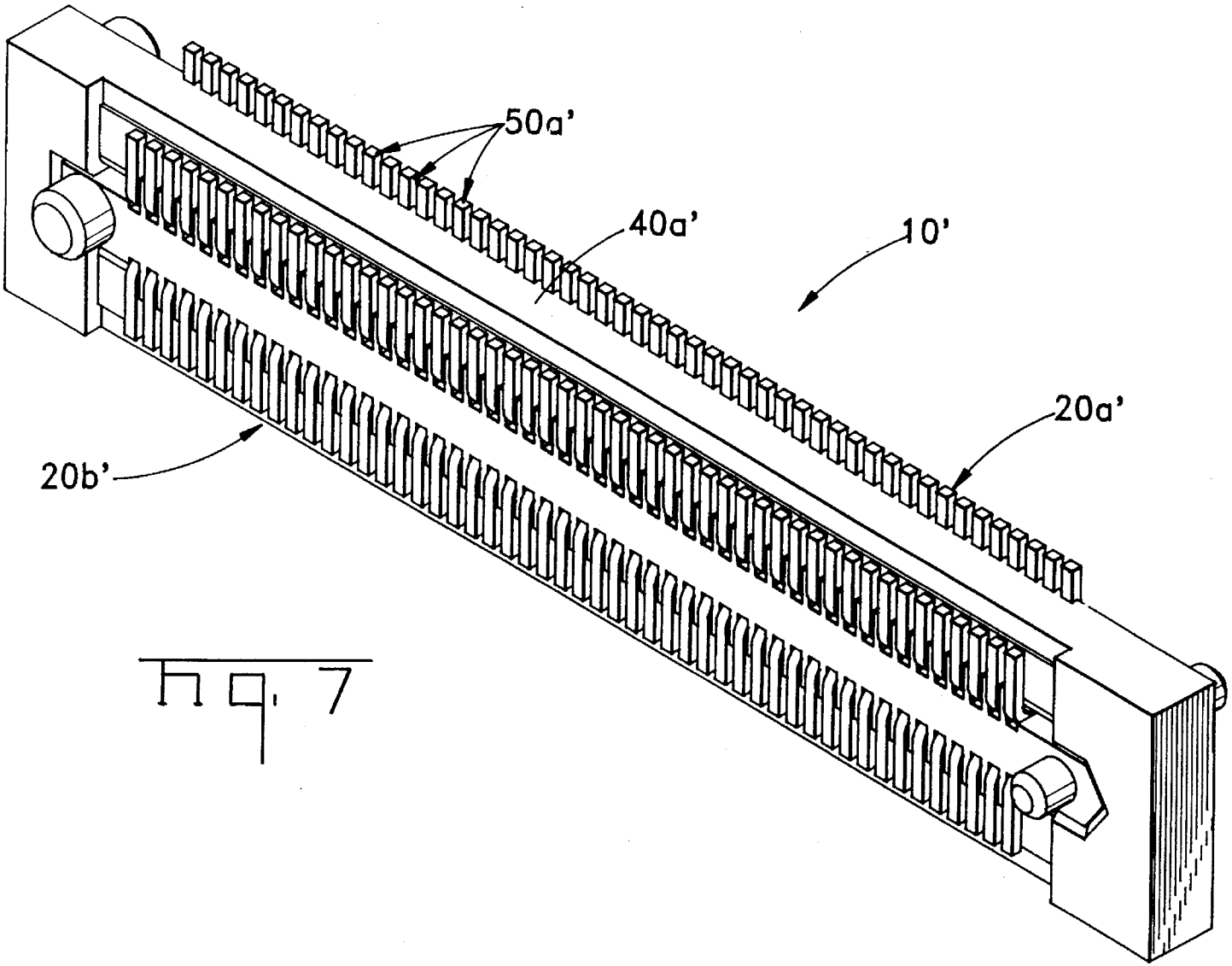
Figure 8:
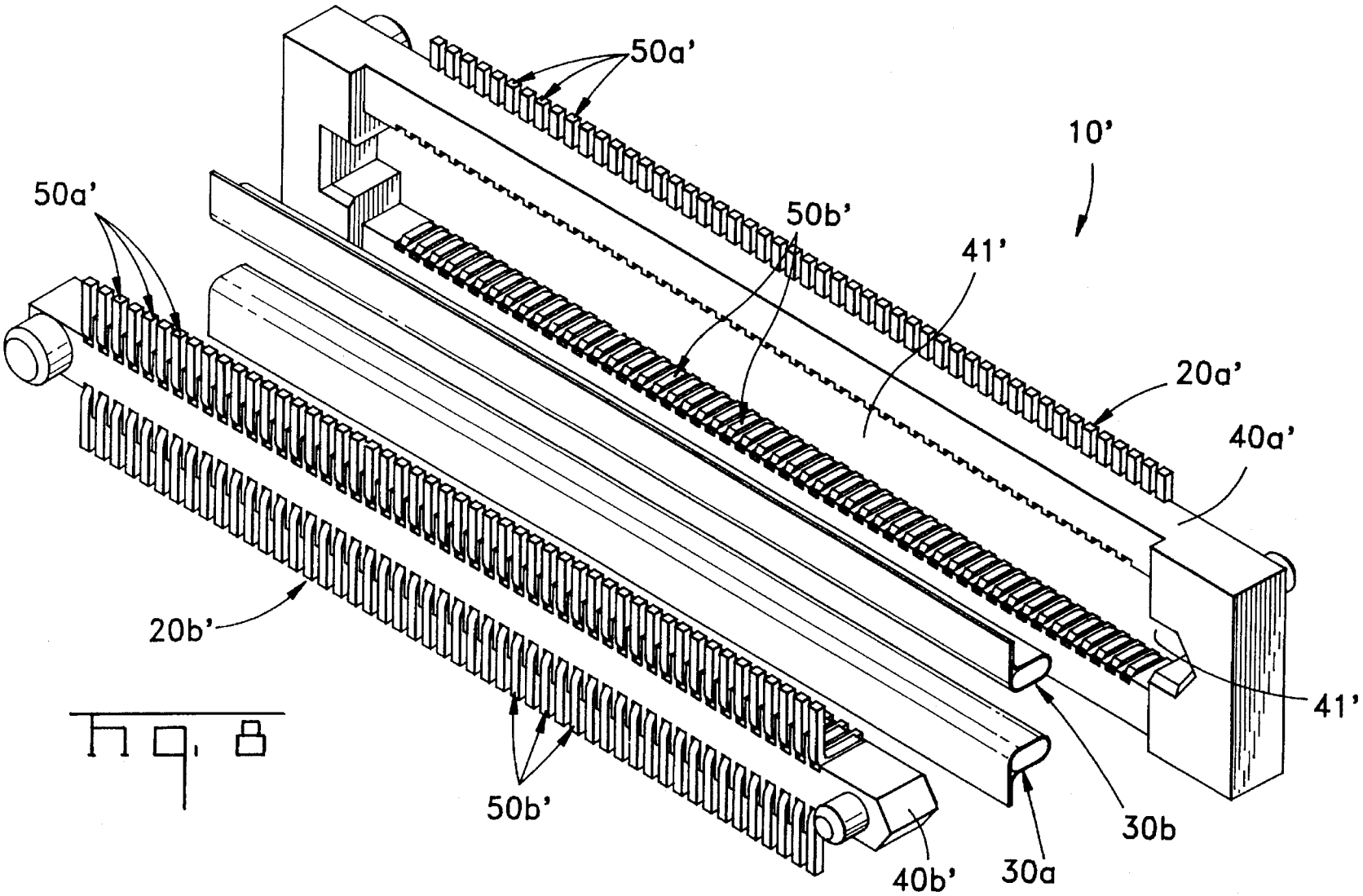

Next, an explanation concerning another embodiment of the connector for base boards according to this invention with reference to FIGS. 7–9 is provided. Except that the contacts 50*a*, 50*b* of the primary connector 20*a*' and the secondary connector 20*b*' are arranged in two rows and are connected to two rows of lands for the purpose of a further increase in the mounting density, the connector 10' for base boards according to this embodiment has basically the same structure as the connector for base boards 10 depicted in FIGS. 1–6. Therefore, an explanation concerning the differences with the connector 10' for base boards is provided.

FIG. 7 is a perspective view of the connector 10' for base boards in an assembled state; FIG. 8 is an exploded perspective view of the connector 10' and FIG. 9 is a cross-sectional view showing contacts corresponding to FIG. 4.

The housing 40*a*' of the primary connector 20*a*' of the connector 10' for base boards has a longitudinal groove 41'. L-shaped contacts 50*a*' are arranged in two rows in the groove 41' of the primary housing 40*a*'. These contacts 50*a*' have connecting sections 51' intended for connection to the base board lands by means of SMT technique. L-shaped contacts 50*b*' are also arranged in two rows in the groove 41' of housing 40*a*'.

The secondary connector 20*b*' is inserted in the groove 41' of the primary housing 40*a*' of the primary connector 20*a*' and securing two elastic connecting components 30*a*, 30*b* therebetween. When the primary and secondary connectors 20*a*' and 20*b*' of this connector 10' for base boards are joined together, the elastic connecting components 30*a*, 30*b* form connections between the contacting sections 52' of contacts 50*a*', 50*b*' arranged in two rows. As a result, using elastic connecting components 30*a*, 30*b*, it is possible to make connections between two rows of the contacts 50*a*', 50*b*' of the primary and secondary connectors 20*a*', 20*b*' attached to two rows of lands by means of the SMT technique. Therefore, using the second embodiment of the connector 10' for base boards shown in FIGS. 7–9, it is possible to increase the density of connections two times compared to the first embodiment shown in FIGS. 1–6.

The method of connecting the base boards using the embodiment of the connector 10' for base boards shown in FIGS. 7–9 is basically the same as in the case of the connector 10 for base boards shown in FIGS. 1–6. That is, two rows of the contacts 50*a*', 50*b*' of the primary connector 20*a*' are aligned with the lands made on the first base board and connected by a SMT method. Next, two rows of the contacts 50*a* ', 50*b*' of the secondary connector 20*b*' are aligned with the lands made on the second base board and connected by a SMT method. Then the contacts 50*a*', 50*b*' of the primary and secondary connectors 20*a*', 20*b*' attached to the first and the second base boards by a SMT method are connected by means of elastic connecting components 30*a*, 30*b*.

Above, explanations have been given concerning preferred embodiments of the connector for base boards according to this invention with reference FIGS. 1 through 9. However, this invention is not limited to only these embodiments, and it should be understood that various modifications may be easily made to it as necessary by a person knowing the art. For example, not all the contacts must be suitable for the SMT-type connection, but may have soldering tails disposed in throughholes made in the base boards.

As follows from the above explanation, the connectors for base boards according to this invention consist of primary and secondary connectors having contacts which are aligned and soldered to the lands made on the inner surfaces of the first and second base boards to be connected. Then both connectors are joined together by means of an elastic connecting component inserted between the contacting sections of the connector contacts. The wiping action generated between these contacting sections and the elastic contacting component makes it possible to obtain highly reliable electrical connections. Since the pressure generated by the elastic connecting component is not applied directly to the base boards, but is parallel to their surfaces, there is no danger that reliability will be compromised due to board warping. In addition to other advantages compared to conventional connectors for base boards, the use of the connectors according to this invention makes it possible to maintain the distance between the boards within 1.5 to 2 mm limits, thus greatly contributing to an increase in the density of mounting of electronic components.

We claim:

1. A connector for interconnecting first and second base boards each having a plurality of electrical lands, comprising:

a plurality of first contacts each having a connecting section arranged for engaging a respective one of the electrical lands on the first base board, and a contacting section;

a plurality of second contacts each having a connecting section arranged for engaging a respective one of the electrical lands on the second base board, and a contacting section; and an elastic connecting component interconnecting the contacting sections of the first contacts with respective ones of the contacting sections of the second contacts.

2. The connector of claim 1 wherein said elastic connecting component comprises an elastomer core having conductive paths formed at a periphery thereof.

3. The connector of claim 2 wherein said conductive paths are formed on a flexible circuit substrate wound around the elastomer core.

4. The connector of claim 1 wherein said first contacts and said second contacts are each arranged in two rows, and a respective said elastic connecting component is interconnected between each said row of first contacts and a corresponding said row of second contacts.

5. The connector of claim 1 wherein each said connecting section of said first and second contacts includes a surface mount solder lead.

6. The connector of claim 1 wherein said first contacts are mounted on a first housing and said second contacts are mounted on a second housing, said elastic connecting component being mounted between the first and second housings.

7. The connector of claim 1 wherein said contacts are located on a centerline to centerline pitch not greater than 0.5 mm.

8. The connector of claim 1 wherein each said contact is L-shaped with said contacting section extending perpendicular to said connecting section.

9. The connector of claim 1 wherein said first and second contacts are mounted on housing means including alignment posts attaching said housing means to said base boards with said contacting sections extending generally perpendicular to said base boards, with said contacting sections of said first contacts opposed to said contacting sections of said second contacts, and with said elastic connecting component positioned between said contacting sections of said first and second contacts.

10. The connector of claim 1 wherein said first and second contacts are respectively positioned on first and second housing; each said housing being independently attachable respectively to said first and second base boards, said elastic connecting component being insertable between said first and second contacts after said housings are independently attached to said first and second base boards.

11. A connector for interconnecting first and second base boards each having a plurality of electrical lands, comprising:

a primary housing having a longitudinal groove and a plurality of first contacts each having a connecting section arranged for engaging a respective one of the lands on the first base board, each of the first contacts also having a contacting section, a secondary housing disposed in the groove of the primary housing, the secondary housing having a plurality of second contacts each having a connecting section arranged for engaging a respective one of the lands on the second base board, each of the second contacts also having a contacting section, and an elastic connecting component disposed in the groove of the primary housing and interconnecting the contacting sections of the first contacts with respective ones of the contacting sections of the second contacts.

12. The connector of claim 11 wherein said elastic connecting component comprises an elastomer core having conductive paths formed at a periphery thereof.

13. The connector of claim 12 wherein said conductive paths are formed on a flexible circuit substrate wound around the elastomer core.

14. The connector of claim 13 wherein ends of said flexible circuit substrate extend beyond said elastomer core, said ends being securable to one of said primary or secondary housing.

15. The connector of claim 11 wherein each said connecting section of said first and second contacts includes a surface mount solder lead.

16. The connector of claim 11 wherein said first contacts and said second contacts are each arranged in two rows, and a respective said elastic connecting component is interconnected between each said row of first contacts and a corresponding said row of second contacts.

17. The connector of claim 11 wherein said primary and secondary housings include means for attaching said housings to said base boards and for pressing said elastic connecting component without applying forces normal to said base boards, thereby preventing warping of aid base boards.

18. The connector of claim 11 wherein said primary and secondary housings are independently attachable to said base boards.

* * * * *